US007093523B2

(12) United States Patent
Gamba et al.

(10) Patent No.: US 7,093,523 B2
(45) Date of Patent: Aug. 22, 2006

(54) TOOL HANDLE IN PARTICULAR OF SCREWDRIVER, CORRESPONDING TOOL, AND RANGE OF TOOLS CONSISTING OF SAID TOOLS

(75) Inventors: Catherine Gamba, Besancon (FR); Fabrice Brocard, Sellieres (FR)

(73) Assignee: Bost Garnache Industries, Arbois (FR)

( * ) Notice: Subject to any disclaimer, the term of this patent is extended or adjusted under 35 U.S.C. 154(b) by 237 days.

(21) Appl. No.: 10/380,679

(22) PCT Filed: Sep. 17, 2001

(86) PCT No.: PCT/FR01/02885

§ 371 (c)(1),
(2), (4) Date: Jul. 21, 2003

(87) PCT Pub. No.: WO02/24416

PCT Pub. Date: Mar. 28, 2002

(65) Prior Publication Data

US 2004/0003688 A1 Jan. 8, 2004

(30) Foreign Application Priority Data

Sep. 20, 2000 (FR) ..... 00 11986

(51) Int. Cl.
*B25G 1/01* (2006.01)

(52) U.S. Cl. ..... 81/489; 81/492; 81/436

(58) Field of Classification Search ..... 81/489, 81/492, 436, 900, 177.1
See application file for complete search history.

(56) References Cited

U.S. PATENT DOCUMENTS

| | | | | |
|---|---|---|---|---|
| 3,302,673 | A | 2/1967 | Forsberg | |
| 4,452,289 | A * | 6/1984 | Smith | 81/177.1 |
| 4,739,536 | A * | 4/1988 | Bandera et al. | 16/430 |
| 5,390,572 | A * | 2/1995 | Gakhar et al. | 81/436 |
| 5,601,003 | A * | 2/1997 | Amtenbrink et al. | 81/489 |
| 6,228,306 | B1 * | 5/2001 | Hoepfl et al. | 264/254 |
| 6,668,751 | B1 * | 12/2003 | Henke | 116/200 |

FOREIGN PATENT DOCUMENTS

| | | |
|---|---|---|
| FR | 2 611 567 | 9/1988 |
| FR | 2 730 658 | 8/1996 |
| GB | 2 208 156 | 3/1989 |

* cited by examiner

*Primary Examiner*—Lee D. Wilson
*Assistant Examiner*—Alvin J. Grant
(74) *Attorney, Agent, or Firm*—Wenderoth, Lind & Ponack, L.L.P.

(57) ABSTRACT

A tool handle having a core (2) adapted to be secured to a screwdriver blade (1), and a sleeve (3) of plastics material placed around the core. The core and the sleeve have portions in relief (9, 20) for mutual positioning in rotation, and mutual positioning devices (5, 10, 11, 14, 17, 21, 22) for mutual positioning in axial translation. The sleeve (3) is a part that is distinct from the core, and is made of a semi-rigid plastics material and is engaged on the core (2) from in front.

13 Claims, 2 Drawing Sheets

TOOL HANDLE IN PARTICULAR OF SCREWDRIVER, CORRESPONDING TOOL, AND RANGE OF TOOLS CONSISTING OF SAID TOOLS

BACKGROUND OF THE INVENTION

The present invention relates to a handle for a tool, in particular for a screwdriver, of the type comprising a core adapted to be secured to a blade of the tool and a sleeve of plastics material placed around the core. The core and the sleeve having portions in relief for mutual positioning in rotation, and mutual positioning means for mutual positioning in axial translation.

This design makes it possible to implement a range of tools, in particular screwdrivers, at low cost and having different finishing layers, all starting from a single blank constituted by the core.

FR-A-2 730 658 proposes a screwdriver of the above-specified type in which the sleeve is overmolded onto the core fitted with the blade.

SUMMARY OF THE INVENTION

An object of the invention is to improve that tool so as to enable production throughput to be increased and also to increase reactivity, i.e. the ease with which the outer appearance of the tool can be modified, while simultaneously reducing manufacturing costs.

For this purpose, the invention provides a handle for a tool, in particular a screwdriver, of the above-specified type, characterized in that the sleeve is a part that is distinct from the core, being made of a semi-rigid plastics material and being engaged onto the core from in front.

The invention also provides a tool, in particular a screwdriver, having a handle as defined above and an extension, in particular a screwdriver blade, fixed in the handle.

The invention also provides a range of tools, in particular screwdrivers, in which all of the tools in the range are as defined above and the handles of all of the tools of the range have the same core and differ in the outside shape and/or the color and/or a coating and/or marking of the sleeve.

BRIEF DESCRIPTION OF THE DRAWINGS

Embodiments of the invention are described below with reference to the accompanying drawings, in which.

DETAILED DESCRIPTION OF THE INVENTION

Figure 1:
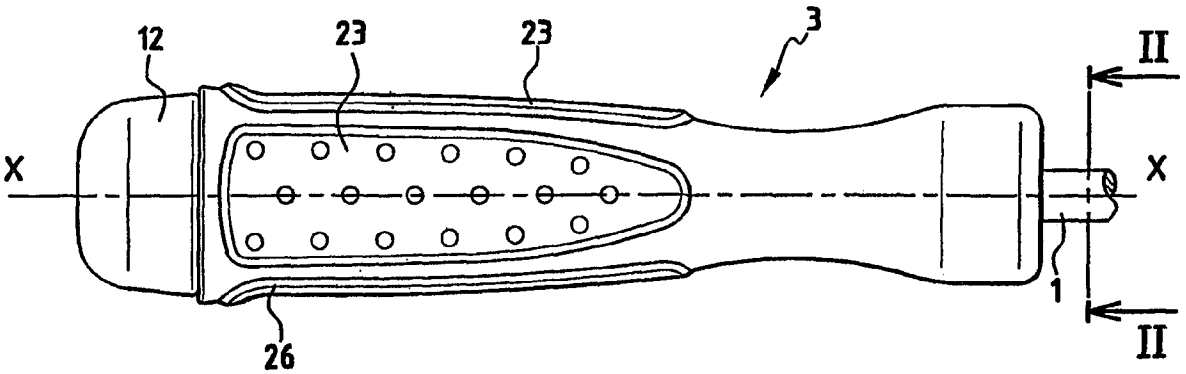
FIG. 1 is an elevation view of a screwdriver constructed in accordance with the invention.
Figure 2:
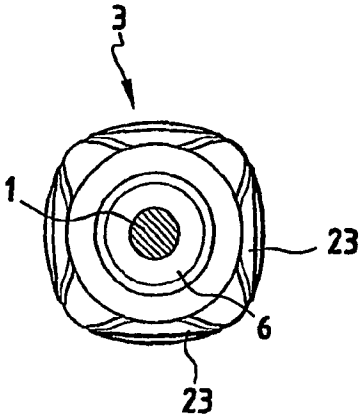
FIG. 2 is an end view from in front taken in section on line II—II of FIG. 1.
Figure 3:
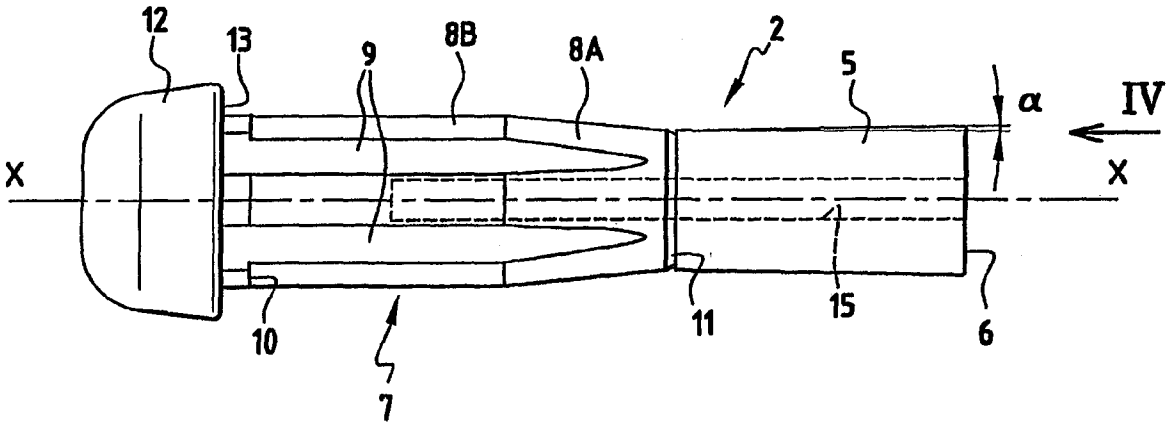
FIG. 3 is an elevation of the core of the FIG. 1 screwdriver.
Figure 4:
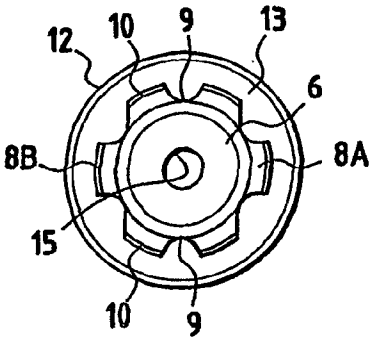
FIG. 4 is an end view from in front of the core, seen looking along arrow IV in FIG. 3.

The screwdriver shown in the drawings has a general axis X—X and is constituted by four parts: a metal blade 1, a core 2 of rigid plastics material, a sleeve 3 of semi-rigid plastics material, and a locking pin 4. These parts are made separately and then assembled together mechanically.

In the text below, the words "front" and "rear" relate respectively to the distal and proximal ends of the handle, and to the right and left ends as shown in FIGS. 1, 3, 5, and 7.

The core 2 is a solid body defining, going from front to rear:

a front portion 5 of small diameter that is substantially frustoconical, converging rearwards with a small angle at the apex $\alpha$ equal to about 0.2° to 1°, for example 0.5°, and whose front end face 6 is plane;

a fluted intermediate portion 7 comprising a forwardly-converging front region 8A followed by a cylindrical rear region 8B, and in which there are provided a plurality (six in this example) of longitudinally-extending cylindrical flutes 9. Close to its rear end, the region 8B has a radial shoulder 10 forming a step of slightly greater height. The portions 5 and 7 of the core are separated by a circular groove 11 having a radial front flank and a forwardly-converging rear flank; and a rear knob 12 of roughly hemispherical shape, having a radial front face 13 joining the rear end of the region 8 and the fluting 9.

Figure 5:
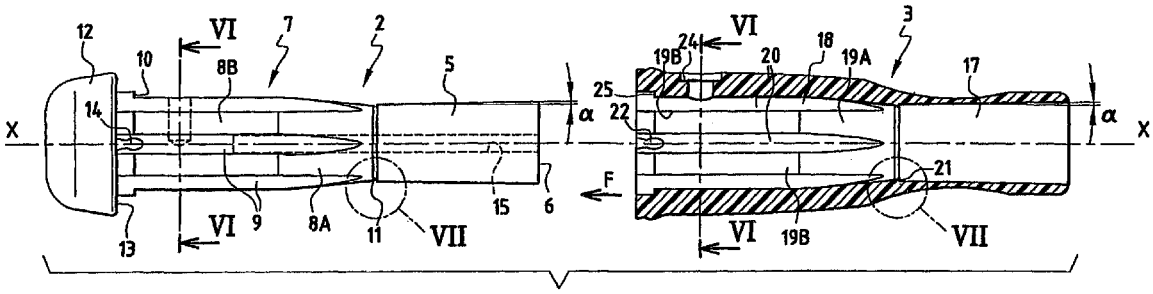
FIG. 5 is an elevation view of the FIG. 3 core after being turned through one-fourth of a turn about its own axis from the position of FIG. 3, together with an axial sectional view of the FIG. 1 screwdriver sleeve ready for engaging on the core.
Figure 6:
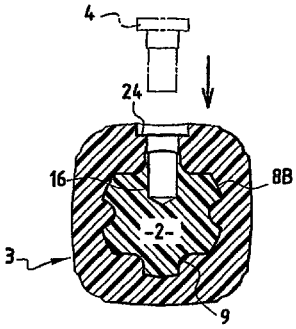
FIG. 6 is a cross-sectional of the assembled screwdriver, the section being taken on lines VI—VI of FIG. 5.

The core 2 also has a localized portion in relief 14 projecting from the bottom of one of the flutes 9. This portion in relief extends axially from the face 13 and presents a shape with an intermediate constriction when seen in plan view (FIG. 5). The core is also provided with an axial blind hole 15 which extends from its front end to an intermediate shoulder of the portion 7, and at the rear end of this hole 15 it has a radial blind hole 16 provided between two flutes 9 (FIGS. 5 and 6).

Figure 7:
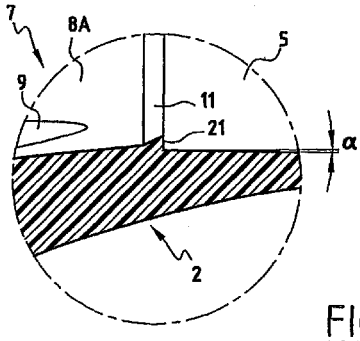
FIG. 7 shows details VII of FIG. 5 on a larger scale, after the sleeve and the core have been assembled together.

The inside shape of the sleeve (FIGS. 5 to 7) is complementary to the outside shape of the portions 5 and 7 of the core. In particular, the sleeve includes a front portion 17 converging rearwardly at the angle $\alpha$, and a rear portion 18 having a rearwardly-diverging front region 19A followed by a cylindrical rear region 19B with six axial splines 20 projecting from its cylindrical inside surface. The portions 17 and 18 are separated by a circular rib 21 whose front flank is radial while its rear flank converges forwards (FIG. 7).

At the rear end of one of the splines 20 there is provided an indentation 22 that is complementary to the portion in relief 14 on the core, and that is open rearwardly.

On the outside, the sleeve has a section which is circular in its portion 17 and which is roughly polygonal (square in this example) in its portion 18. Its profile lengthwise (FIG. 5) on going from front to rear convex, then concave, and then substantially parallel to the axis X—X. Each face of the portion 18 has portions in relief 23 with rounded edges formed thereon (FIG. 1) for improving grip on the tool.

A stepped radial orifice 24 is formed through the sleeve between two splines 20, and a hollow radial shoulder 25 is provided at the rear end of the cylindrical surface 19B.

The core 2 and the sleeve 3 are made separately by injection molding, the sleeve is engaged on the core by being threaded on from in front (arrow F in FIG. 5), with its indentation 22 in the same radial half-plane as the portion in relief 14. The splines 20 penetrate into the fluting 9 until the shoulders 10 of the core come into abutment against the complementary shoulders 25 of the sleeve. At the end of this movement, the portion in relief 14 snaps into the indentation 22 and the rib 21 snaps into the groove 11. The front end of the sleeve is then substantially in register with the end face 6 of the core, leaving the end face visible.

The sleeve is then prevented from turning relative to the core by the splines 20 and the fluting 9, and it is locked in translation, rearwards by the shoulders 10, and forwards by three means: firstly by co-operation between the rib 21 and the groove 11; secondly by the undercut surfaces 5 and 17; and finally by the portion in relief 14 snap-fastening in the indentation 22.

To supplement and to reinforce this locking arrangement, the pin 4 is forced through the orifice 24 and into the hole 16 in the core (FIG. 6).

The assembly operations, including force-fitting the rear portion of the blade 1 in the axial hole 15 of the core, can be performed automatically. The same applies to marking the sleeve which is easy to take hold of and to manipulate because it is semi-rigid.

The term "semi-rigid" is used to mean that it has the property of being substantially undeformable, while nevertheless being sufficiently elastic to deform slightly under the action of high forces of the kind developed in a press (i.e., when the sleeve is press-fitted on the core). This is in contrast both to the almost completely rigid core material, and to the flexibility of elastomers.

By way of example, the core can be made of polypropylene or of cellulose acetate, while the sleeve can be made of soft polypropylene which is a material sold under the trade name "Santoprene".

Depending on the application, recourse may be had to any appropriate combination of the four axial locking means described above (5-17, 11-21, 14-22, and 4-16-23). The first three locking means are completely hidden by the sleeve, while the pin 4 is visible in its orifice 24 and can then be used for color coding.

In a variant, the sleeve may be made as a composite part having part or all of its outside surface covered in a more flexible surface layer for gripping purposes, as referenced 26 in FIG. 1.

In another variant, the core 2 may be overmolded on the blade 1.

The invention claimed is:

1. A handle for a tool, the handle comprising:

a core formed of rigid material and being adapted to be secured to a blade of the tool; and a sleeve formed of semi-rigid plastics material, said sleeve being press-fitted onto the core, wherein said core and said sleeve are each provided with relief portions for mutual positioning in a rotational direction, and mutual positioning means for mutual positioning in an axial direction, wherein the sleeve is a part that is distinct from the core, and the semi-rigid material is substantially non-deformable so as to permit the sleeve to be press-fitted onto the core from a front end thereof, wherein the mutual positioning means comprise rear abutment means and locking means for locking the sleeve in a rear abutment position, wherein the locking means comprises cooperating portions in relief on the core and on the sleeve, said cooperating portions in relief being hidden by the sleeve, and wherein the locking means further comprises complementary surfaces on said core and said sleeve, wherein said complementary surfaces extend from the front end faces of said core and said sleeve and converge rearwardly so as to lock the sleeve in its rear abutment position.

2. A handle according to claim 1, wherein the sleeve extends to the front end of the core.

3. A handle according to claim 1, wherein an angle of convergence of said complementary surfaces lies substantially in the range of 0.2° to 1°.

4. A handle according to claim 3, wherein said angle of convergence is substantially 0.5°.

5. A handle according to claim 1, wherein the sleeve includes a gripping layer provided on at least a portion of the outside surface, said grip layer being made of a material that is more flexible than the semi-rigid plastics material.

6. A handle according to claim 1, wherein the tool handle is a screwdriver handle.

7. A handle according to claim 1, wherein said portion in relief is provided in said sleeve and said recess is provided in said core, and said portion in relief is provided at the rear end of the converging surface of said sleeve.

8. A handle for a tool, the handle comprising:

a core formed of rigid material and being adapted to be secured to a blade of the tool; and a sleeve formed of semi-rigid plastics material, said sleeve being press-fitted onto the core, wherein said core and said sleeve are each provided with relief portions for mutual positioning in a rotational direction, and mutual positioning means for mutual positioning in an axial direction, wherein the sleeve is a part that is distinct from the core, and the semi-rigid material is substantially non-deformable so as to permit the sleeve to be press-fitted onto the core from a front end thereof, wherein the mutual positioning means comprise rear abutment means and locking means for locking the sleeve in a rear abutment position, wherein said locking means comprises at least one male portion in relief of said core or of said sleeve snap-fastening axially in a recess formed in the other one of said core or said sleeve.

9. A handle according to claim 8, wherein said male portion in relief is a circular rib and said recess is a circular groove.

10. A handle according to claim 9, wherein said groove has a radial front flank and a forwardly-converging rear flank, and said rib has a radial front flank and a forwardly-converging rear flank.

11. A handle according to claim 8, wherein said portion in relief is provided in said sleeve and said recess is provided in said core.

12. A handle according to claim 8, wherein said portion in relief is a localized projection on a rear portion of the core, and said localized projection is adapted to snap axially into a rearwardly-open localized recess provided at a rear end of the sleeve.

13. A handle for a tool, the handle comprising:

a core formed of rigid material and being adapted to be secured to a blade of the tool; and a sleeve formed of semi-rigid plastics material, said sleeve being press-fitted onto the core, wherein said core and said sleeve are each provided with relief portions for mutual positioning in a rotational direction, and mutual positioning means for mutual positioning in an axial direction, wherein the sleeve is a part that is distinct from the core, and the semi-rigid material is substantially non-deformable so as to permit the sleeve to be press-fitted onto the core from a front end thereof, wherein the mutual positioning means comprise rear abutment means and locking means for locking the sleeve in a rear abutment position, and wherein the locking means comprises a locking pin which passes through a radial orifice of the sleeve and penetrates a radial recess of the core.

* * * * *